US010835910B2

(12) United States Patent
Goutayer et al.

(10) Patent No.: US 10,835,910 B2
(45) Date of Patent: Nov. 17, 2020

(54) DEVICE FOR PACKAGING AND DISPENSING A PRODUCT IN AN AIRLESS MANNER, NOTABLY IN SEVERAL PHASES, ASSOCIATED PURGE RING AND METHOD

(71) Applicant: CAPSUM, Marseilles (FR)

(72) Inventors: Mathieu Goutayer, Saint Malo (FR); Yan Eric Pafumi, Gardanne (FR)

(73) Assignee: CAPSUM, Marseilles (FR)

( * ) Notice: Subject to any disclaimer, the term of this patent is extended or adjusted under 35 U.S.C. 154(b) by 0 days.

(21) Appl. No.: 16/071,794

(22) PCT Filed: Jan. 20, 2017

(86) PCT No.: PCT/EP2017/051251

§ 371 (c)(1),
(2) Date: Aug. 7, 2018

(87) PCT Pub. No.: WO2017/125590

PCT Pub. Date: Jul. 27, 2017

(65) Prior Publication Data

US 2019/0022679 A1 Jan. 24, 2019

(30) Foreign Application Priority Data

Jan. 22, 2016 (FR) ..... 16 50524

(51) Int. Cl.
*B05B 11/00* (2006.01)
*B05B 15/30* (2018.01)

(52) U.S. Cl.
CPC ..... *B05B 11/0081* (2013.01); *B05B 11/0097* (2013.01); *B05B 11/00416* (2018.08);
(Continued)

(58) Field of Classification Search
CPC ..... B05B 11/0081; B05B 11/00416; B05B 11/0097; B05B 11/0044; B05B 11/00446;
(Continued)

(56) References Cited

U.S. PATENT DOCUMENTS 4,793,522 A * 12/1988 Corsette ..... B65D 83/0033 222/257
4,817,829 A * 4/1989 Fuchs ..... B05B 11/3061 222/259

(Continued)

FOREIGN PATENT DOCUMENTS

EP 0571280 A1 11/1993
FR 2855505 A1 12/2004

(Continued)

OTHER PUBLICATIONS

Search Report for French Patent Application FR 16 50524 dated Sep. 9, 2016.

(Continued)

*Primary Examiner* — Patrick M. Buechner
*Assistant Examiner* — Randall A Gruby
(74) *Attorney, Agent, or Firm* — Pearne & Gordon LLP

(57) ABSTRACT

This device comprises: a container defining an inner volume intended to contain the product closed off by a movable bottom and opening out through a dispensing neck; a dispensing member; a purge ring comprising a base that delimits a central orifice defining a central axis of the ring, the base having an outer contour and a side surface converging from the outer contour toward a second end of the central orifice. The device is characterized in that the purge ring comprises at least one radial opening arranged radially relative to the central axis and allowing the passage of the product from the container toward the central orifice.

18 Claims, 6 Drawing Sheets

(52) U.S. Cl.
CPC ..... *B05B 15/30* (2018.02); *B05B 11/00446* (2018.08); *B05B 11/3045* (2013.01); *B05B 11/3047* (2013.01); *B05B 11/3074* (2013.01)

(58) Field of Classification Search
CPC ..... B05B 11/3042–3074; B05B 15/30–37; B65D 83/32
USPC ..... 222/464.1–464.7
See application file for complete search history.

(56) References Cited

U.S. PATENT DOCUMENTS 4,949,875 A * 8/1990 Kuo ..... A46B 11/0006 222/156
5,085,350 A * 2/1992 Sugita ..... B05B 11/0056 222/260
5,217,050 A * 6/1993 Varlet ..... B05B 11/0097 141/2
5,449,094 A 9/1995 Behar et al.
5,738,067 A * 4/1998 Landwehr ..... A45D 40/26 132/320
6,240,979 B1 * 6/2001 Lorscheidt ..... B05B 11/0097 141/2
6,302,304 B1 * 10/2001 Spencer ..... B05B 11/3001 222/260
6,712,243 B2 * 3/2004 Rossignol ..... B05B 11/00418 222/207
7,367,476 B2 * 5/2008 Law ..... B05B 11/0032 222/153.06
7,578,319 B2 8/2009 Behar et al.
7,677,415 B2 * 3/2010 Auer ..... B05B 11/3035 222/207
8,534,506 B2 * 9/2013 Bohnisch ..... B05B 11/3047 222/321.9
8,556,130 B2 * 10/2013 Law ..... B05B 11/3047 222/256
8,631,976 B2 * 1/2014 Moretti ..... B05B 11/3008 222/321.9
8,939,323 B2 * 1/2015 Knight ..... A61M 11/00 222/153.13
9,096,362 B2 * 8/2015 Von Schuckmann ..... B65D 83/0033
9,446,425 B2 * 9/2016 Bibette ..... B01F 5/0694
9,993,398 B2 6/2018 Goutayer et al.
10,406,546 B2 * 9/2019 Rossignol ..... B05B 11/0041
10,427,181 B2 * 10/2019 Rossignol ..... B05B 11/0044
10,464,088 B2 * 11/2019 Knight ..... B05B 11/3061
2003/0230600 A1 * 12/2003 Masuda ..... B05B 11/3023 222/321.7
2006/0196889 A1 * 9/2006 Masuda ..... B05B 11/007 222/256
2006/0255071 A1 * 11/2006 Behar ..... B05B 11/3015 222/256
2007/0084110 A1 * 4/2007 Rossignol ..... B65D 83/0005 47/48.5
2007/0119868 A1 * 5/2007 Kraemer ..... B65D 83/0033 222/256
2008/0116229 A1 * 5/2008 Kang ..... A45D 34/04 222/390
2010/0294805 A1 * 11/2010 Pohlmann ..... B05B 11/0072 222/207
2011/0233824 A1 * 9/2011 Alaterre ..... B29C 45/261 264/328.12
2014/0103071 A1 * 4/2014 Park ..... A45D 34/00 222/207
2014/0183229 A1 * 7/2014 Van Swieten ..... B05B 11/3033 222/256
2015/0102064 A1 * 4/2015 Taberlet ..... B05B 11/3047 222/153.05
2016/0136666 A1 * 5/2016 Kang ..... B05B 11/3028 222/182
2016/0175863 A1 * 6/2016 Bloc ..... B05B 11/3047 222/190
2017/0216865 A1 * 8/2017 Rossignol ..... B05B 11/3045
2019/0217322 A1 * 7/2019 Kelders ..... B05B 11/007
2020/0094278 A1 * 3/2020 Flynn ..... B05B 11/3002

FOREIGN PATENT DOCUMENTS

FR 2972371 A1 9/2012
FR 3012050 A1 4/2015
JP H02295912 A 12/1990
JP H08282709 A 1/1996
JP H11100055 A 4/1999

OTHER PUBLICATIONS

International Search Report Translation for PCT/EP2017/051251 dated May 2, 2017.
International Written Opinion for PCT/EP2017/051251 dated May 2, 2017.

* cited by examiner

DEVICE FOR PACKAGING AND DISPENSING A PRODUCT IN AN AIRLESS MANNER, NOTABLY IN SEVERAL PHASES, ASSOCIATED PURGE RING AND METHOD

FIELD OF THE INVENTION

The present invention relates to a device for packaging and dispensing a product in an airless manner, in particular in several phases.

The product in several phases is advantageously a cosmetic product, a biologically active product, or an edible product able to be consumed.

BACKGROUND OF THE INVENTION

Such a product is for example formed by a first phase in the form of drops dispersed in a second liquid phase so as to form an emulsion. The second phase is substantially immiscible with the first phase.

Such a product for example comprises a dispersion of the water-in-oil or oil-in-water type comprising kinetically stable drops of dispersed phase, with a size greater than 500 μm, or greater than 1000 μm, and in particular comprised between 500 μm and 3000 μm, preferably between 700 μm and 2000 μm, and better between 800 μm and 1200 μm.

Such a product is in particular obtained using a microfluidic method, in particular as described in FR 2,972,371 A1 or FR 3,012,050 A1.

Aside from an interesting visual, a product with several phases as described above has the advantage of preserving the integrity of the active ingredient(s) encapsulated within the drops dispersed in the continuous phase, until the time of dispensing, or optionally, consumption of said product.

The large size of the drops of a product obtained using a microfluidic method is further advantageous in that it contributes to a significant decrease in the specific surface and therefore dispersion phenomena of the light at the interfaces and thus contributes to maximizing the transparency of the emulsion.

However, products of this type generally have low mechanical strengths, which may lead to shearing or fragmentation of the drops during the transport of these products. That is why these products are generally marketed in airless dispensing devices.

Such a device nevertheless has the advantage of making it possible to dispense the product irrespective of the orientation of the device, in particular right side up or upside down.

In a known manner, an airless dispensing device has a container topped by an airless dispensing pump, i.e., a pump that has a double valve with no air passage.

To compensate for the volume of product that has been dispensed, the bottom of the container is formed by a moving piston that slides inside the container. The piston rises inside the container when a dose of product is suctioned in a dosing chamber of the pump.

When the dispensing device is filled with product, it is necessary to completely expel the residual air located above the product introduced into the container.

To that end, it is known to use a purge ring. This ring is associated with the pump. It has a frustoconical flexible skirt narrowing toward the bottom of the container and pierced with a central orifice communicating with a suction conduit of the pump. The skirt is provided to press resiliently against an inner wall of the container.

Upon filling, the moving piston is placed in the low position in the container. The product is introduced into the container in excess relative to its nominal volume. The pump with the purge ring is next placed at the apex of the container.

The skirt of the purge ring then comes into contact with the product, which expels the air and the excess product above the skirt. More specifically, the air and the excess product escape at the zone of the skirt of the purge ring pressing against the inner wall of the container. This air and this excess product are then in a dead space located above the purge ring and this excess product will not be dispensed. Conversely, the volume located between the skirt and the moving piston only contains product that will be suctioned through the suction conduit of the pump.

However, such an airless dispensing device is not fully satisfactory.

In particular, the suctioning of the product by the pump is not always effective. Indeed, in such a device, static volumes sometimes appear in the product below the ring. Thus, dispensing the product contained in these static volumes is difficult, if not impossible in some cases. This effect is particularly remarkable when the product is a product with several phases, in particular as described above.

Furthermore, in this case, the suctioning by the pump of the product with several phases produces zones in which the dispersion of the phase dispersed in the continuous phase becomes nonhomogeneous. These are in particular referred to as depletion zones. In particular, in a suction zone adjacent to the suction conduit of the pump, the concentration of drops decreases. On the contrary, in a zone adjacent to the purge ring, the concentration of drops of the dispersed phase can even increase considerably. This then leads to a nonhomogeneous distribution of the drops of product in the container. Furthermore, when the container is transparent, this creates a relatively unattractive esthetic effect for a user.

SUMMARY OF THE INVENTION

The present invention aims to propose a device for packaging and dispensing, in an airless manner, a product having improved suction qualities, and in particular making it possible to overcome the aforementioned drawbacks.

To that end, the invention relates to a device for packaging and dispensing a product in an airless manner, in particular in several phases, said device comprising:

- a container, in particular tubular, defining an inner volume intended to contain the product, having two ends and a side wall extending between the ends along a longitudinal axis, the inner volume being closed off by a movable bottom and opening out through a dispensing neck, the side wall delimiting an inner surface of the inner volume;
- a dispensing member comprising a dispensing pump fastened on the dispensing neck, said dispensing pump including a suction conduit for the product;
- a purge ring comprising a base delimiting a central passage orifice for the product, the central orifice comprising a first end in which the suction conduit of the pump opens out and a second end opposite the first end, the central orifice defining a central axis of the ring extending between the first end and the second end;

the base having an outer contour and a side surface extending between the outer contour and the central orifice, the side surface converging from the outer contour toward the second end of the central orifice;

the outer contour of the ring coming into tight contact with the inner surface of the container; and a dead space formed between the purge ring and the dispensing member;

the device being characterized in that the purge ring comprises at least one radial opening arranged radially relative to the central axis, the at least one radial opening emerging in the central orifice and allowing the passage of the product from the container toward the central orifice.

According to other advantageous aspects of the invention, the packaging and dispensing device comprises one or more of the following features, considered alone or according to all technically possible combinations:

the ring is fastened to the suction conduit by gripping of the suction conduit in the central orifice;

the base of the ring has a skirt extending around the central axis;

the skirt converges from the outer contour of the base toward the second end of the central orifice;

the ring includes a central sleeve protruding in the base opposite the bottom, the central sleeve inwardly defining the first end of the central orifice;

the at least one radial opening results from the fitting of a strainer on the side surface of the base of the ring;

the strainer has a cylindrical shape, defines two ends and includes a side wall extending between the ends of the strainer along the central axis, one of the ends being closed off and the other being fitted on the side surface of the base, at least one radial opening being arranged on the side wall of said strainer;

the at least one radial opening is formed by a deflector forming a deflection cap mounted on the second end of the central orifice, extending across from the side surface of the base and covering at least part of the side surface of the base, the side surface and the cap forming at least one flow channel for the product between them connecting the at least one radial opening to the central orifice;

the base of the ring and the deflector are made in a single integral piece;

the at least one radial opening is formed by at least one slit extending over the side surface of the ring while moving radially away from the central axis of the ring;

the at least one slit flares as it moves radially away from the central axis of the ring;

the ring is made by injection or by additive manufacturing;

the inner volume of the container comprises a product including at least one phase in the form of drops dispersed in another phase;

the side surface of the base is intended to partially close the inner volume opposite the movable bottom;

the product is an oil-in-water emulsion, a water-in-oil emulsion, or even a multiple emulsion, in particular of the oil-in-water-in-oil or water-in-oil-in-water type, and preferably an oil-in-water emulsion; and the central axis of the ring coincides with the longitudinal axis of the container.

The invention also relates to a ring intended to be inserted into a device for packaging and dispensing a product, in particular with several phases, as previously defined;

the purge ring comprising a base delimiting a central passage orifice for the product, the central orifice comprising a first end in which the suction conduit of the pump opens out and a second end opposite the first end, the central orifice defining a central axis of the ring extending between the first end and the second end;

the base having an outer contour and a side surface extending between the outer contour and the central orifice, the side surface converging from the outer contour toward the second end of the central orifice;

the outer contour of the ring being intended to come into tight contact with the inner surface of the container;

the purge ring being characterized in that it further comprises at least one radial opening arranged radially relative to the central axis, the at least one radial opening emerging in the central orifice and allowing the passage of the product from the container toward the central orifice.

The invention also relates to a method for dispensing a product, in particular with several phases, comprising the following steps:

providing a dispensing device as previously defined, the inner volume containing the product;

actuating the dispensing pump;

driving a movement of the product in the container;

suctioning the product through the at least one radial opening of the ring.

BRIEF DESCRIPTION OF THE DRAWINGS

These features and advantages of the invention will appear upon reading the following description, provided solely as a non-limiting example, and done in reference to the appended drawings, in which.

DETAILED DESCRIPTION OF THE INVENTION

Figure 1:
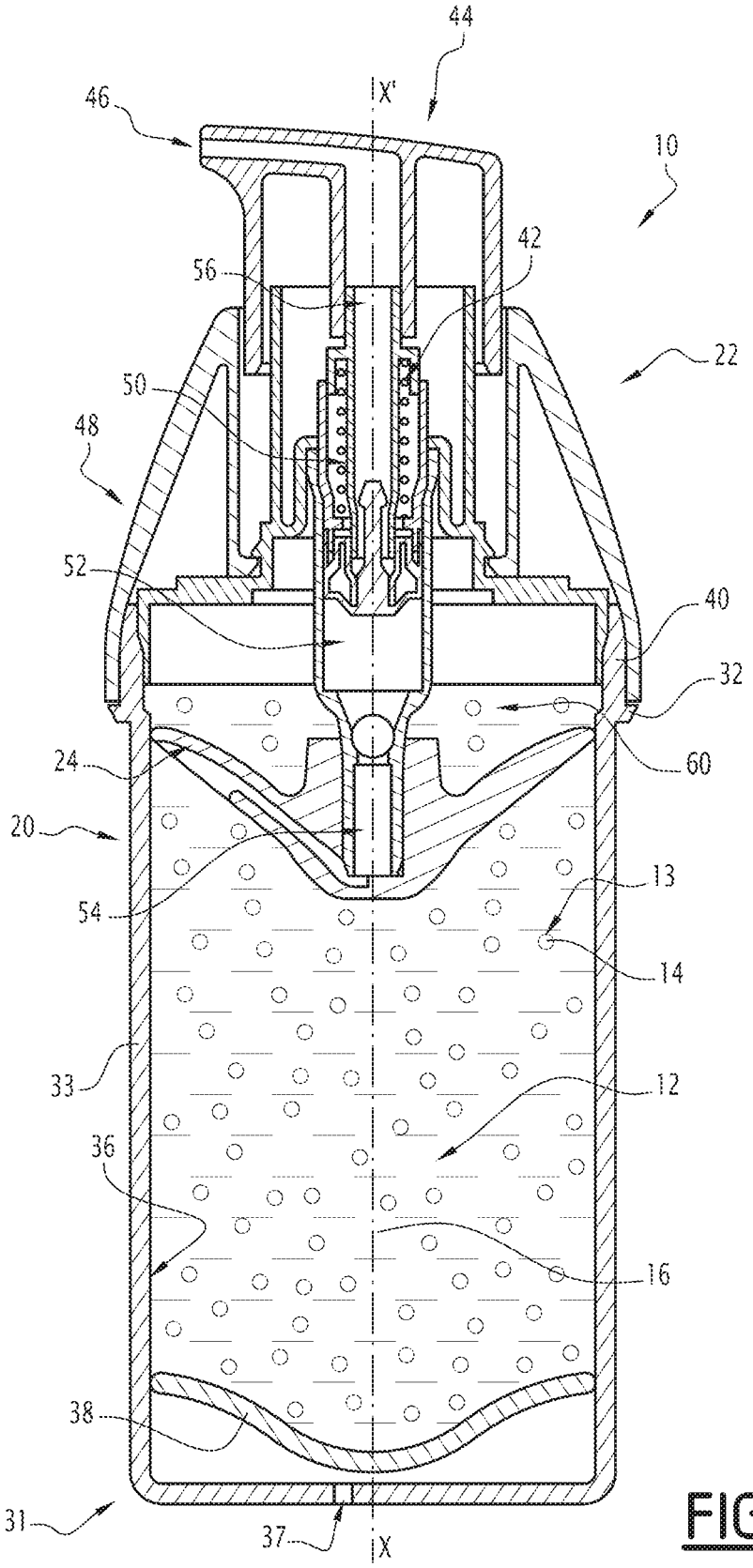
FIG. 1 is a longitudinal schematic view of a packaging and dispensing device according to the invention, the device including a purge ring according to a first embodiment of the invention.

The dispensing device 10 of FIG. 1 makes it possible to package and dispense a product 12 in an airless manner. In other words, the dispensing device 10 makes it possible to prevent any contact of the non-dispensed product 12 with air during the packaging of this product 12.

The product 12 is for example a product with several phases.

The product 12 in several phases is in particular a cosmetic product, a biologically active product, or an edible product able to be consumed.

The product 12 comprises a dispersion of drops 13 of a first phase 14 dispersed in a second phase 16 substantially immiscible with the first phase 14.

According to a first embodiment, the first phase 14 is an oily phase and the second phase 16 is an aqueous phase.

According to a second embodiment, the first phase 14 is an aqueous phase and the second phase 16 is an oily phase.

The first phase 14 is advantageously an oily phase, in particular comprising at least one oil.

"Oil" refers to a greasy substance that is liquid ambient temperature (25° C.).

Examples of oils usable in the present invention include:

- hydrocarbon oils of animal origin, such as perhydrosqualene and squalane;
- esters and synthetic esters, in particular fatty acids, such as oils with formulas R1COOR2 and R1OR2 in which R1 represents the remainder of a fatty acid in C8 to C29, and R2 represents a hydrocarbon chain, which may or may not be branched, in C3 to C30, for example isononyl isononanoate;
- linear or branched hydrocarbons, of mineral or synthetic origin, such as paraffin oils, volatile or not, and their derivatives, Vaseline, polydecenes, hydrogenated polyisobutenes such as Parleam oil;
- silicone oils, for example polymethyl siloxanes (PDMS), volatile or not, with linear or ring silicon chain, liquid or pasty at ambient temperature, in particular cyclopolydimethylsiloxanes (cyclomethicones), polydimethylsiloxanes (or dimethicones) including alkyl, alkoxy or phenyl groups, during or at the end of silicone chain, groups having 2 to 24 carbon atoms; phenyl chains;
- fatty alcohols having 8 to 26 carbon atoms, such as cetyl alcohol;
- hydrocarbon and/or silicone fluorinated oils like those described in document JP-A-2-295912; and
- mixtures thereof.

The first phase 14 and/or the second phase 16 can in particular comprise at least one product that may be chosen from a biologically active product, a cosmetic product, or a consumable comestible product.

When the first product is a biologically active product, it is chosen from among anticoagulants, antithrombotics, antimitotic agents, antiproliferative agents, anti-adhesion agents, anti-migration agents, cell adhesion promoters, growth factors, antiparasitic molecules, anti-inflammatories, angiogenics, angiogenesis inhibitors, vitamins, hormones, proteins, antifungals, antimicrobial molecules, antiseptics, antibiotics and mixtures thereof.

Alternatively, the second phase 16, in particular when made up of an aqueous phase, may comprise at least one reagent, for example proteins or reagents intended to form a bio-reagent, or to form artificial cells for implants.

A cosmetic product is for example cited in Directive 93/35/CEE by the Council dated Jun. 14, 1993. This product is for example a cream, emulsion, lotion, gel or oil for the skin (hands, face, feet, etc.), a makeup foundation (liquid, paste), a bath and shower preparation (salts, forms, oils, gels, etc.), a haircare product (hair dyes and bleaches), a cleaning product (lotions, powders, shampoos), a scalp maintenance product (lotions, creams, oils), a skincare and/or makeup product, a hairstyling product (lotions, hair sprays, brillantines), a shaving product (soaps, foams, lotions, etc.), a product intended to be applied on the lips, a sun product, a sunless tanning product, a product making it possible to bleach the skin, an anti-wrinkle product.

The edible products able to be consumed by a human or animal are advantageously purées of vegetables or fruits such as mango purée, pear purée, coconut purée, onion cream, leek cream, carrot cream, or other preparations that can mix several fruits or vegetables. Alternatively, it involves oils such as a dietary oil, such as olive oil, soy oil, grape seed oil, sunflower oil, or any other oil extracted from plants.

The first phase 14 and/or the second phase 16 may also comprise molecules of cosmetic interest, such as active ingredients, dyes, stabilizers, preservatives, modifying agents chosen from among texture, viscosity, pH, osmotic force or refractory index modifier agents.

According to one embodiment, the oily phase, or even the product 12, according to the invention has a viscosity comprised from 1 mPa·s to 500,000 mPa·s, preferably from 10 mPa·s to 300,000 mPa·s, better from 400 mPa·s to 100,000 mPa·s, and more particularly from 1,000 mPa·s to 30,000 mPa·s, as measured at 25° C. and according to the method described in FR 3,012,050.

Of course, one skilled in the art will choose the aforementioned products and/or reagents and/or molecules of cosmetic interest and/or their quantity such that the advantageous properties of the dispersion according to the invention are not altered at all or not substantially by the considered addition. These adjustments are part of the skills of one skilled in the art.

Advantageously, the product 12 is transparent or substantially translucent.

"Substantially translucent" means that the absorbance of the considered product is generally lower than 5%, preferably lower than 2%, preferably lower than 1% for at least one wavelength in the visible spectrum comprised from 400 nanometers to 1000 nanometers, advantageously over the entire wavelength of the visible spectrum from 400 nanometers to 1000 nanometers.

Advantageously, the product 12, and more particularly the first phase 14 and/or the second phase 16 of said product 12, and/or the container 20, is/are colored, while nevertheless retaining the at least translucent nature previously mentioned, so as to further reinforce the visual attractiveness of the product 12, or even of the device 10 comprising said product 12.

The first phase 14 and the second phase 16 are substantially immiscible. Thus, the solubility of the first phase 14 in the second phase 16 is advantageously less than 5% by mass.

The drops 13 are dispersed in the second phase 16 homogeneously.

The drops 13 have a mean diameter greater than 500 μm, or greater than 1000 μm, and in particular comprised between 500 μm and 3000 μm, preferably between 700 μm and 2000 μm, and better between 1000 μm and 1500 μm.

Advantageously, the content of the drops 13 is preserved inside said drops during the filling of the product 12 in the dispensing device 10 and during its packaging in this device 10.

Preferably, this content is preserved until the dispensing/consumption of the product 12 by a user.

In general, the product 12 corresponds to any product able to be obtained using the method described in FR 2,972,371 A1 or FR 3,012,050 A1.

Alternatively, the product 12 corresponds to any other product in several phases known in itself.

The dispensing device 10 comprises a container 20 intended to contain the product 12, a dispensing member 22 for this product 12 and a purge ring 24 making it possible to expel the air from the container 20 during filling of the dispensing device 10.

According to one alternative embodiment (not shown), the dispensing device 10 further comprises a receptacle intended to contain at least the container 20. The receptacle is for example transparent or at least translucent and has a suitable shape. In particular, the inner shape of the receptacle is for example substantially complementary to the outer shape of the container 20, and the outer shape of the receptacle for example has a desired ergonomic shape. According to one particular embodiment, the receptacle has a prism or straight (or rectangular rhomb) shape and the container 20 has a tubular (or cylindrical) shape.

The container 20 has a lower end 31, an upper end 32 and a side wall 33 extending between the ends 31 and 32 along a longitudinal axis X-X'.

The container 20 has a tubular shape with a constant cross-section at least between its ends 31 and 32. The cross-section is advantageously circular.

The side wall 33 in particular delimits an inner surface 36 laterally delimiting a variable inner volume containing product 12. The inner surface 36 is in contact with the product 12.

The lower end 31 of the container 20 is partially closed off by a radial extension of the side wall 33 of the container 20 and delimits a suction orifice 37 for suctioning air into this extension.

The lower end 31 includes a piston 38 movable along the longitudinal axis X-X' between an initial position and a final position.

The piston 38 is in its initial position when the container 20 is completely filled with product 12. In this position, the piston 38 is adjacent to the lower end 31 of the container 20.

The piston 38 is in its final position when the container 20 is substantially empty. In this position, the piston 38 is adjacent to the upper end 32 of the container 20.

Thus, as the product 12 is dispensed, the piston 38 is able to rise along the longitudinal axis X-X' while sliding along the inner surface 36 of the side wall 33 to its final position abutting against the purge ring 24.

The piston 38 thus downwardly delimits the inner volume containing the product 12.

During its travel, the piston 38 comes into contact with the inner surface 36 of the side wall 33 so as to be tight while suctioning air at atmospheric pressure via the suction orifice 37.

Preferably, the piston 38 has a shape substantially complementary to the shape of the purge ring 24 explained hereinafter. This embodiment is in particular advantageous in that it makes it possible to reduce the static volumes previously described.

The upper end 32 of the container 20 is open and has a dispensing neck 40 on which the dispensing member 22 is assembled.

The dispensing member 22 includes a dispensing pump 42, a pushbutton 44 able to be actuated by the user and delimiting a dispensing orifice 46, and a protective cap 48 covering the dispensing neck 32 of the container 20 and the pump 42.

The pump 42 is a pump of the dual valve airless type, known in itself.

In particular, the pump 42 comprises a body 50 fastened on the dispensing neck 32 of the container 20 and including a dosing chamber 52, a suction conduit 54 penetrating the container 20 and a dispensing conduit 56 communicating with the dispensing orifice 46.

The dosing chamber 52 is delimited by two valves, one of which opens out into the suction conduit 54 and the other into the dispensing conduit 56.

The inner volume of the dosing chamber 52 corresponds to a dose of the product 12 delivered in a single actuation of the pump 42.

The purge ring 24 is mounted on the suction conduit 54. Thus, a dead space 60 is formed between the pump 42 and the purge ring 24. This dead space is dedicated to comprising the air and the excess product 12 present in the container 20 and thus to guaranteeing the absence of air in the container 20 under usage conditions. In particular, the product 12 contained in this dead space 60 is not intended to be dispensed via the pump 42.

Figure 2:
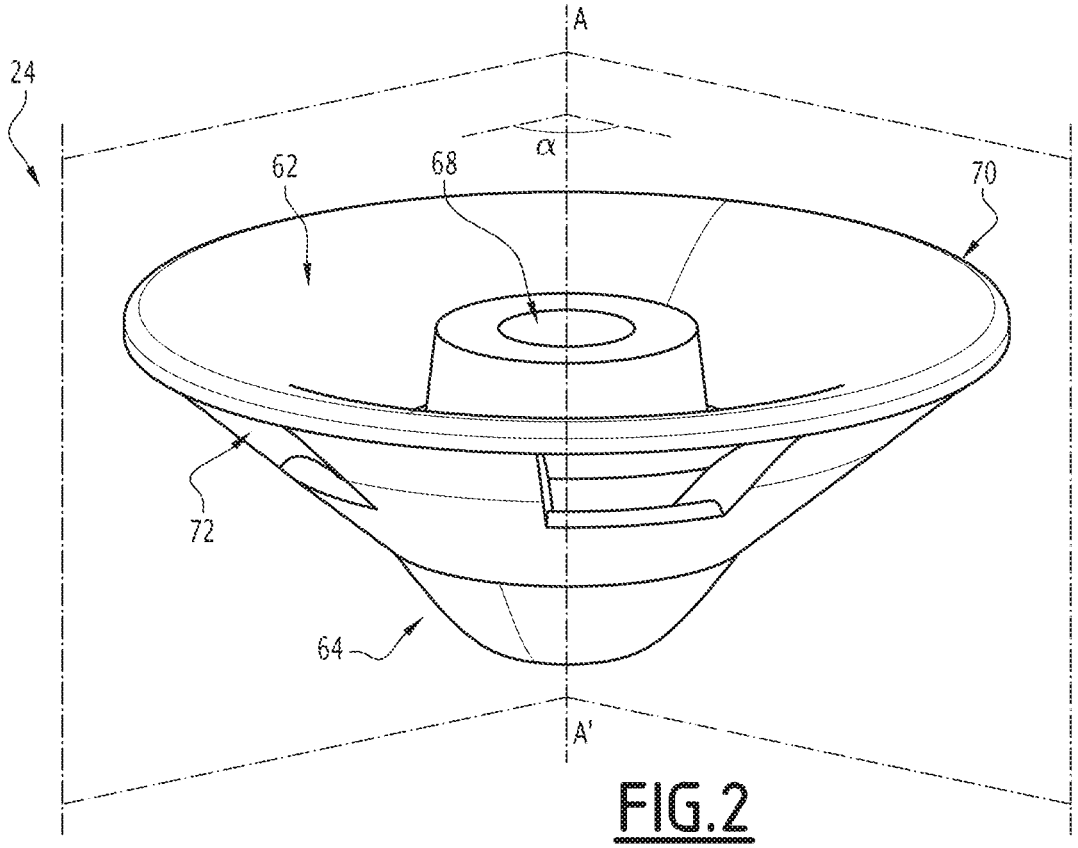
FIG. 2 is a perspective view of the purge ring of FIG. 1.
Figure 3:
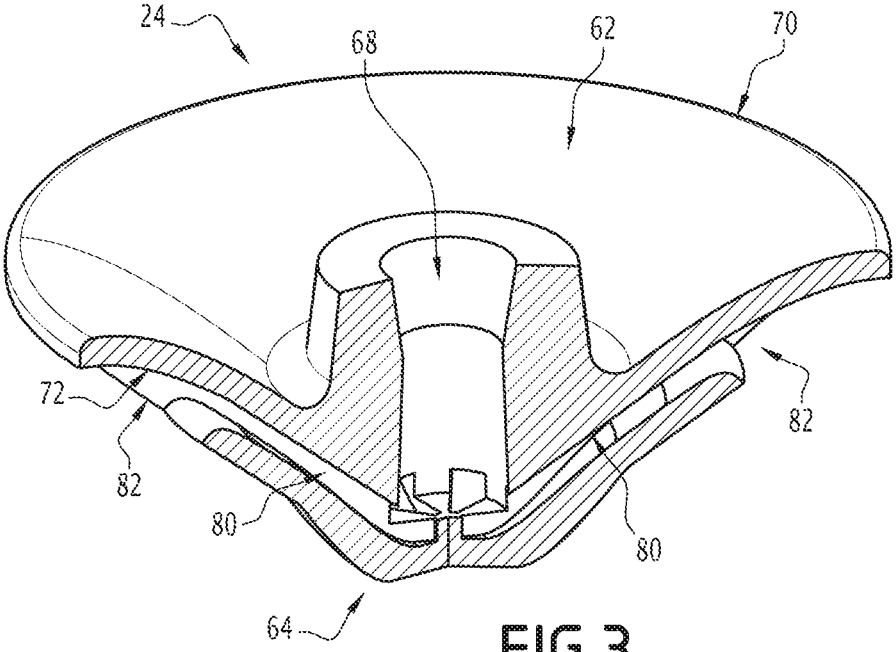
FIG. 3 is a sectional view in two radial half-planes of the purge ring of FIG. 2.

The purge ring 24 according to the first embodiment of the invention is illustrated in more detail in FIGS. 2 and 3.

Thus, in reference to these figures, the purge ring 24 comprises a base 62 and a deflector 64.

The base 62 of the purge ring 24 delimits a central orifice 68 comprising a first end in which the suction conduit 54 of the pump 42 opens out and a second end opposite the first end.

The central orifice 68 defines a central axis A-A' of the ring 24. The central axis A-A' coincides with the longitudinal axis X-X' when the ring 24 is mounted on the suction conduit 54.

In particular, as illustrated in FIG. 1, the ring 24 is fitted on the suction conduit 54 in the central orifice 68, in particular without the suction conduit 54 completely traversing it. The suction conduit 54 is thus gripped in the central orifice 68.

To that end, the ring 24 includes a central sleeve with axis A-A' inwardly defining the first end of the central orifice 68.

The base 62 is made in the form of a frustoconical skirt having a contour 70 and a side surface 72 extending between the central orifice 68 and the contour 70.

The side surface 72 converges from the outer contour 70 toward the second end of the central orifice 68.

The base 62 of the purge ring 24 according to the invention preferably adopts a shape and/or is made from a material guaranteeing it resilient deformation properties in order to allow the passage of air and excess product 12 from the container 20 toward the dead space 60 during the fastening of the dispensing member 22 with the purge ring 24 previously mounted on the suction conduit 54 on the dispensing neck 40 of the container 20.

The skirt advantageously has a shape converging downward, i.e., toward the lower end 31 of the container 20 when the purge ring 24 is mounted on the suction conduit 54. This embodiment is advantageous in that it further facilitates the passage of air and excess product 12 from the container 20 toward the dead space 60.

The skirt is advantageously symmetrical relative to the central axis A-A'. The sleeve defining the central orifice 68 protrudes upward in the skirt opposite the movable bottom.

The contour 70 has a shape substantially similar to the shape of the cross-section of the container 20. Advantageously, the contour 70 has a circular shape.

Thus, the contour 70 is able to come into tight contact with the inner surface 36 of the container 20 tightly. In particular, the contour 70 presses resiliently against the inner surface 36 of the container 20.

The side surface 72 is able to come into contact, at least partially, with the product 12. It upwardly delimits, opposite the bottom, the inner volume containing the product.

According to the first embodiment, the deflector 64 is made up of a deflecting cap mounted on the second end of the central orifice 68 and extending upward across from the side surface 72 of the purge ring 24 while partially covering this surface 72.

Preferably, the deflecting cap is mounted transversely relative to the central axis A-A'.

Preferably, the deflecting cap is in the form of a skirt, the narrow part of which is closed off. The skirt partially follows the side surface 72 of the ring 24.

Preferably, the deflecting cap and the side surface 72 are axially offset along the central axis A-A' relative to one another so as to form at least one circulation channel 80 between them for the product 12.

The or each channel 80 emerges on one side in the central orifice 68 and on the other side in a radial opening 82 on the side surface 72. The or each radial opening 82 is radially offset relative to the central axis A-A'.

Thus, the product 12 is able to circulate in the or each channel 80 by entering through the corresponding radial opening 82 toward the central orifice 68, then toward the suction conduit 54.

In the example embodiment of FIGS. 2 and 3, five channels 80 are formed between the deflecting cap and the side surface 72.

The channels 80 are arranged uniformly around the central axis A-A' and form radial openings 82 arranged uniformly around the central axis A-A'.

Thus, according to this example embodiment, the openings 82 are spaced radially apart substantially by 72°.

In particular, FIG. 3 corresponds to a sectional view of FIG. 2 by two half-cutting planes passing through the central axis A-A' and forming an angle $\alpha$ substantially equal to 144°. This makes it possible to view two channels 80 in sectional view in FIG. 3.

The base 62 and the deflector 64 are made from a flexible material, in particular polyethylene or high-density polyethylene, using a production technique known in itself, such as injection or additive manufacturing. The flexibility in particular of the base 62 makes it possible to provide a sufficient resilient deformation of the ring 24 so as to guarantee the passage of air and excess product 12 from the container 20 to the dead space 60 as well as the tightness between the inner surface 36 and the ring 24, in particular the outer contour 70 of said ring 24.

According to one example embodiment, the base 62 and the deflector 64 are made in the form of two separate parts. According to this example, the deflector 64 is able to be fitted on the side surface 72 of the base 62.

According to another example embodiment, the base 62 and the deflector 64 are made in a single integral piece.

The method for dispensing of the product 12 by the dispensing device 10 will now be explained in detail in reference to FIG. 4.

Initially, the dispensing device 10 is filled with product 12. In particular, to fill the dispensing device 10, the product 12 is first placed in excess in the container 20. Then, the dispensing number 22 with the purge ring 24 mounted on the suction conduit 54 is fastened on the dispensing neck 40 of the container 20.

During such an assembly, the air and the excess product 12 escape from the container 20 at the outer contour 70 of the ring 24. A dead space 60 of product 12 between the purge ring 24 and the pump 42 is then formed. This operation mechanically guarantees the absence of air in the container 20. At the same time, part of the air present in the container 20 before the aforementioned assembly can also be expelled via the channels 80 and the central orifice 68, which then ends up in the dosing chamber 52.

The purge ring 24, in particular the outer contour 70 of said purge ring 24, cooperates tightly with the inner surface 36 of the container 20.

When the user actuates the pump 42 by pushing on the pushbutton 44, the product 12 is first suctioned in the dosing chamber 52, then in the dispensing conduit 56 to ultimately be dispensed through the dispensing orifice 46.

In particular, during suction, the air is not introduced into the container 20 and the volume of product 12 dispensed is compensated by the rising of the piston 38, which is then pushed by the atmospheric pressure owing to the suction orifice 37.

Inside the container 20, the radial openings 82 make it possible to create several radial flows (or streams) near the purge 24.

Figure 4:
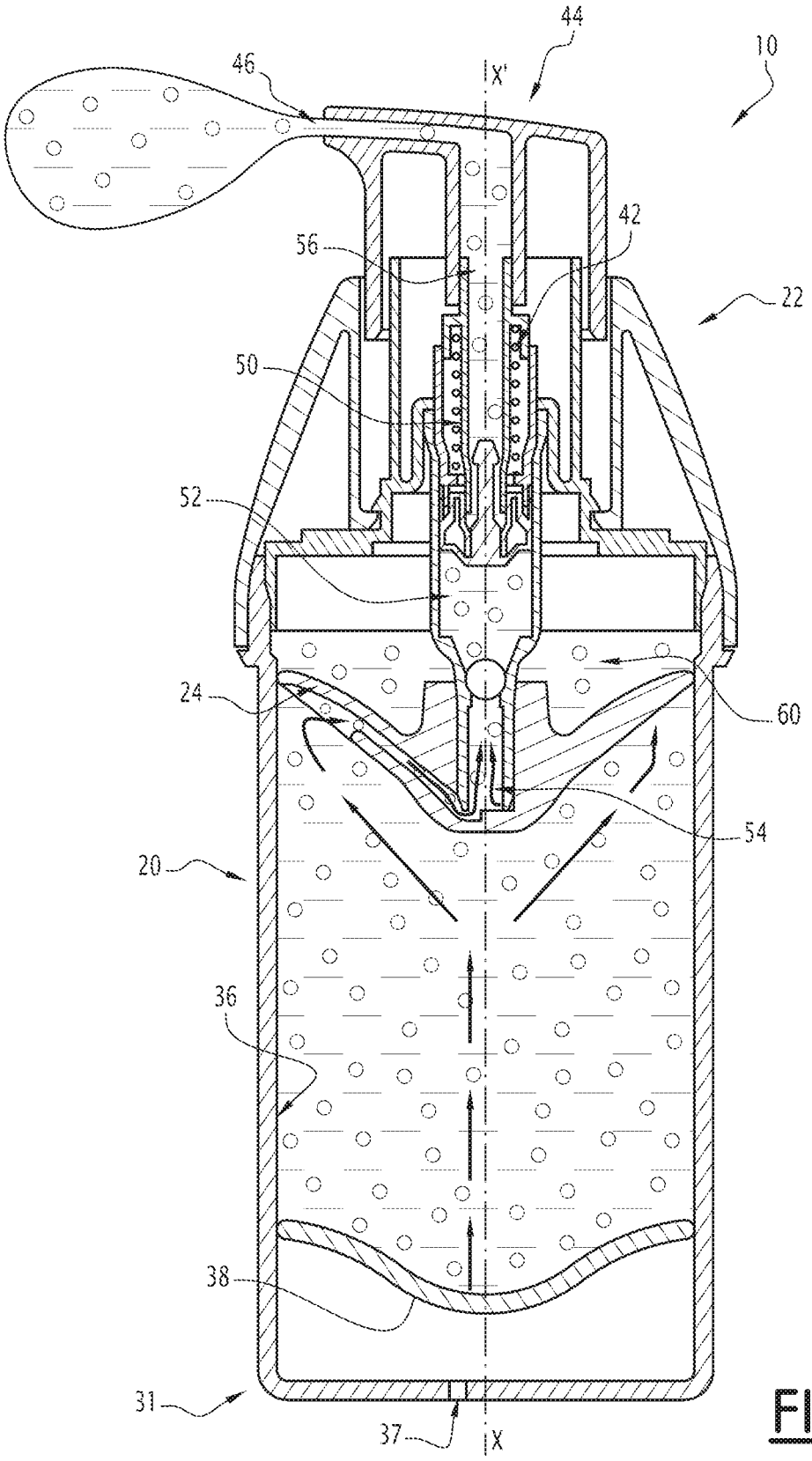
FIG. 4 is a view similar to that of FIG. 1, illustrating a dispensing method according to the invention.

In particular, as illustrated in FIG. 4, near the purge ring 24, the product 12 moves in directions perpendicular to the longitudinal axis X-X'. The product 12 is therefore suctioned radially from the inner surface 36 of the container 20 toward the longitudinal axis X-X'.

Within the channels 80, the product 12 circulates even partially toward the bottom 38 of the container before performing a bend to rise along the longitudinal axis X-X' in the central orifice 68.

Inside the purge ring 24, the product 12 circulates in the channels 80 radially toward the central orifice 68, through which it next flows in the longitudinal direction.

The product 12 is dispensed by actuating the pump 42 until the piston 38 abuts against the purge ring 24. Thus, the product 12 contained in the dead space 60 is not dispensed via the pump 42.

One can then see that the present invention has a certain number of advantages.

In particular, the dispensing device 10 according to the invention makes it possible to dispense a product 12 without creating static volumes below the ring 24.

This effect is achieved owing to the modification of the conventional purge ring. In particular, a deflector added to the side surface of the purge ring deflects the flow of the product to cause a radial component of the flow speed to appear.

This then favors the suctioning of the product near the inner surface 36 of the container 20 and makes it possible to avoid static volumes.

Furthermore, the downwardly converging shape of the purge ring, combined with the presence of a radial opening through the ring, makes it possible to avoid static volumes along the side surface of the ring.

When the product 12 is a product in several phases, in particular with one phase presented in the form of drops dispersed in another one, the dispensing device 10 according to the invention further makes it possible to retain the homogeneity of this product, and in particular to retain the homogeneous dispersion of the drops in the product.

In this case, the deflector avoids depletion zones, or even stagnation zones, of the drops. Thus, the dispersion of drops remains homogeneous in the product during the packaging and dispensing of this product, in particular near the purge ring 24.

A purge ring 124 according to a second embodiment of the invention will be outlined hereinafter in reference to FIGS. 5 to 8.

The purge ring 124 is substantially similar to the purge ring 24 previously described.

In particular, the purge ring 124 is intended to be mounted in a dispensing device similar to the dispensing device 10 previously described.

Like in the previous case, the purge ring 124 includes a base 162. However, unlike the first embodiment, the purge ring 124 has no deflector.

The base 162 is similar to the base 62 already described. In particular, the base 162 delimits a central orifice 168, has a contour 170 and a side surface 172 extending between the contour 170 and the central orifice 168. Like in the previous case, the central orifice 168 makes it possible to fit the purge ring 124 to a suction conduit of the dispensing device similar to the suction conduit 54.

Unlike the base 62 of the purge ring 24, the base 162 of the purge ring 124 delimits at least one slit 180 extending over the side surface 172 of the base 162.

In particular, the or each slit 180 extends from one end 181 of the base 162 in which the central orifice 168 opens out, moving radially away from the central axis A-A'. The or each slit 180 for example extends in a straight line, called slit line, over the side surface 172.

The or each slit 180 thus forms a radial opening 182 communicating with the central orifice 168 and creates a radial component of the circulation speed of the product 12 during its dispensing.

According to FIGS. 5 and 6, and FIGS. 7 and 8 respectively showing a first and second example embodiment of the purge ring 124, the base 162 delimits three slits 180 spaced regularly apart around the central axis A-A'. Thus, these slits 180 are spaced radially apart substantially by 120°.

Figure 5:
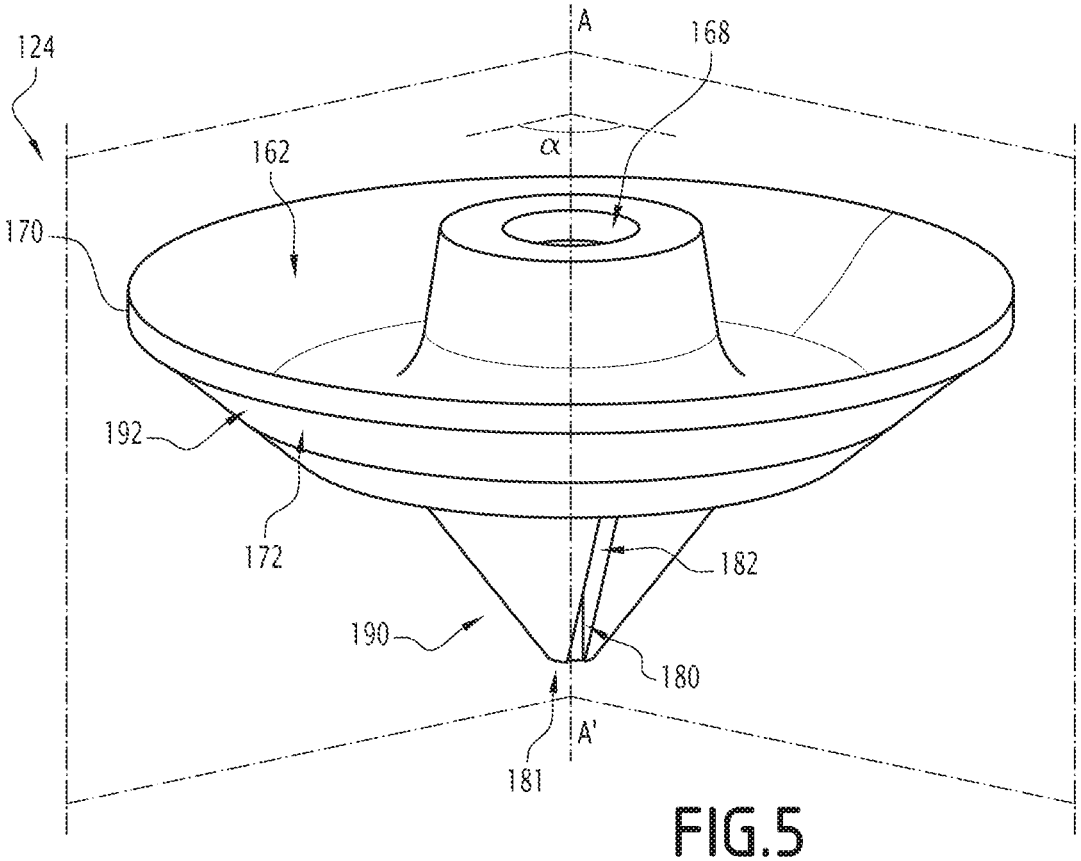
FIG. 5 is a perspective view of a purge ring according to a second embodiment of the invention.
Figure 6:
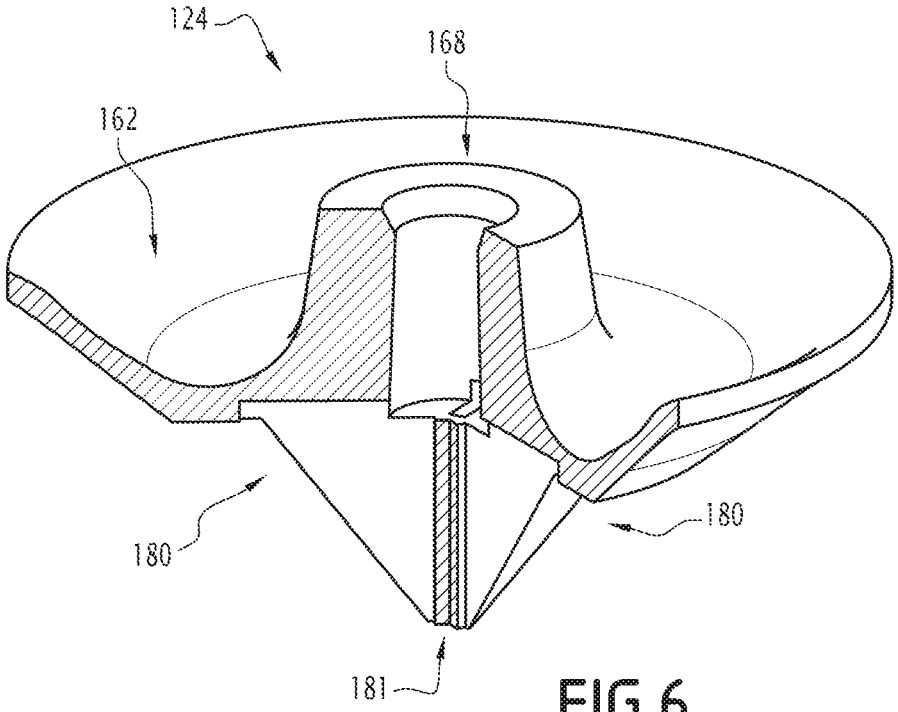
FIG. 6 is a sectional view in two radial half-planes of the purge ring of FIG. 5.
Figure 7:
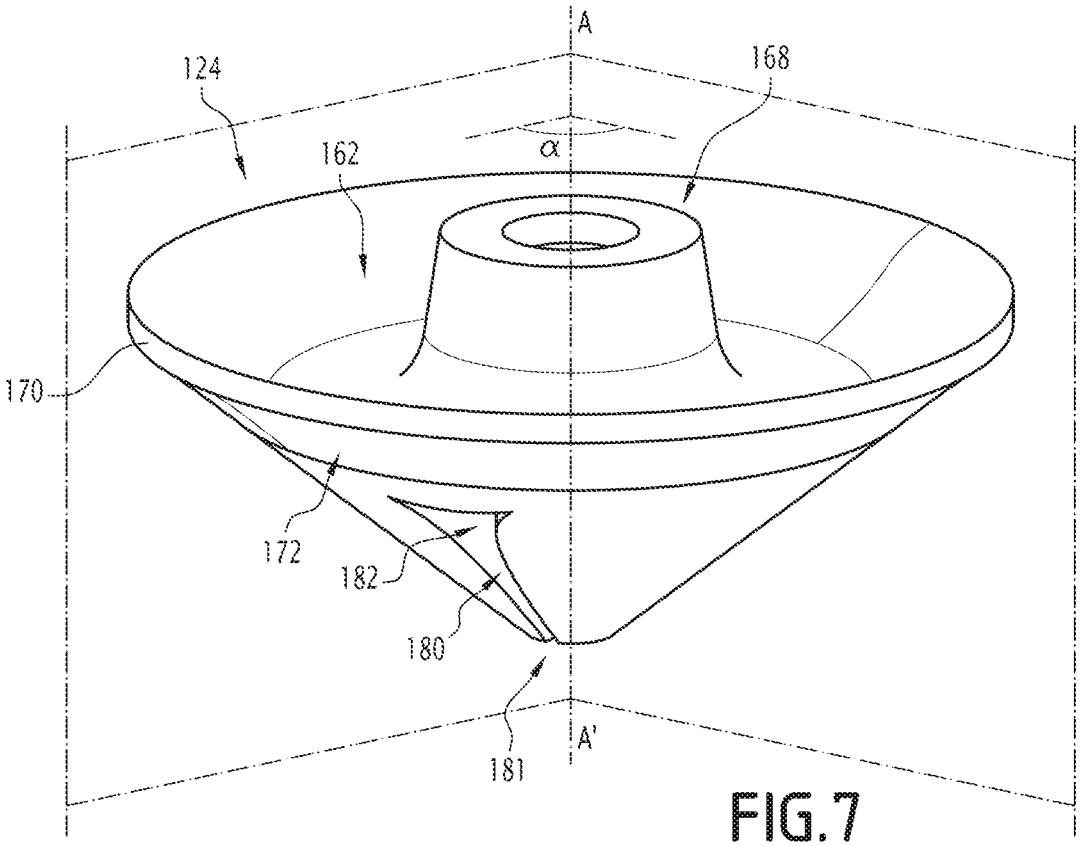
FIG. 7 is a perspective view of a purge ring according to an alternative embodiment of the purge ring of FIG. 5.
Figure 8:
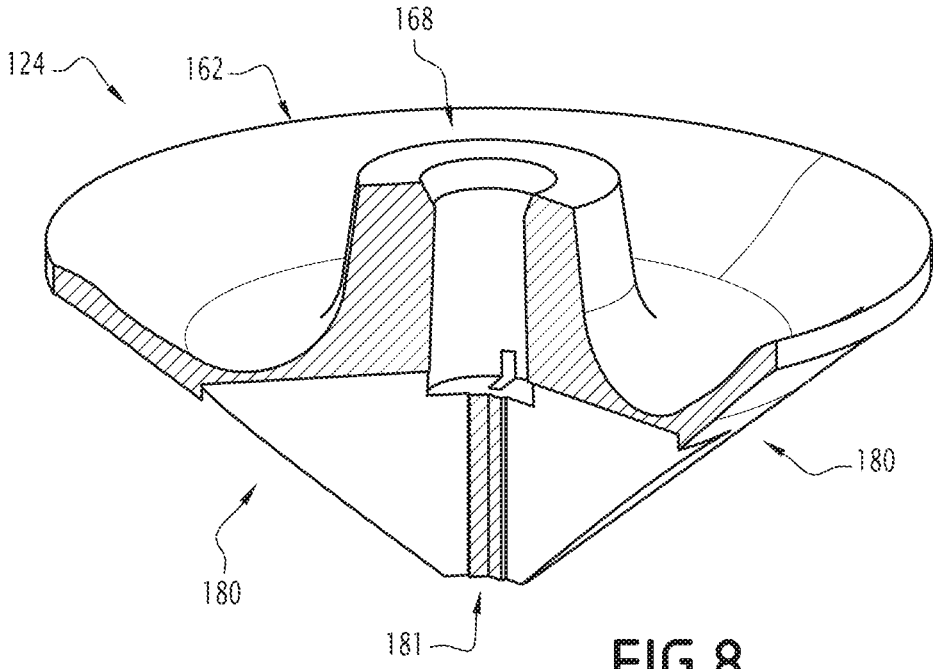
FIG. 8 is a sectional view in two radial half-planes of the purge ring of FIG. 7.

Unlike the preceding case, the angle α between two half-cutting planes of FIGS. 5 and 7 is substantially equal to 120°, which makes it possible to view two slits 180 in sectional view in FIGS. 6 and 8, respectively.

According to the first example embodiment illustrated in FIGS. 5 and 6, the slits 180 have a substantially constant cross-section.

Furthermore, according to this example embodiment, the base 162 has a stepped form with a lower level 190 in the form of a cone, the apex of which corresponds to the end 181, and an upper level 192 in the form of a narrow skirt toward the lower level 190. The slits 180 extend over the part of the side surface 172 delimited by the lower level 190.

According to the second example embodiment illustrated in FIGS. 7 and 8, the slits 180 flare as they move radially away from the central axis A-A'.

According to this example embodiment, the base 162 is in the form of a skirt substantially similar to that of the base 62.

The dispensing method carried out by a dispensing device with the dispensing ring 124 mounted therein is similar to that previously described.

In particular, the slits 180 of the ring 124 cause a radial flow near the ring 124 during the dispensing of the product 12, which favors the suctioning of the product 12 from the inner surface of the container.

The particular advantage of the purge ring 124 according to the second embodiment lies in the simplicity of its manufacturing.

Indeed, the purge ring 124 can be manufactured by a simple injection method in a mold with two shells, none of the walls of this part being undercut relative to the central axis A-A'.

According to one preferred embodiment, in the first and second example embodiments of the purge ring 124, the length of the projection of the or each slit line on the central axis A-A' is greater than the length of the projection of the or each slit line on a plane perpendicular to the central axis A-A'. For example, the length of the projection of the or each slit line on the central axis A-A' is two times greater than the length of the projection of the or each slit line on a plane perpendicular to the central axis A-A'. This embodiment is advantageous in that it also favors the radial flow near the ring 124 during the dispensing of the product 12. Indeed, the projection of the or each slit line on the plane perpendicular the central axis A-A' then corresponds to the shortest path for the product 12 to reach the orifice 168. The suctioning of the product 12 is therefore preferably done at the projection of the or each slit line on the plane perpendicular to the central axis A-A', which contributes to amplifying the desired radial flow.

The second embodiment of the purge ring 124 is advantageous in that it favors suctioning of the product 12 at the zones of the slit(s) 180 having the greatest radial separation from the central axis A-A'.

As previously indicated, according to the second example embodiment of the purge ring 124, the slits 180 flare as they move radially away from the central axis A-A'. This second embodiment is advantageous in that it even more strongly favors suctioning of the product 12 at the zones of the slit(s) 180 having the greatest radial separation from the central axis A-A', and therefore favors the desired radial flow.

A purge ring 224 according to a third embodiment of the invention will be outlined hereinafter in reference to FIGS. 9 and 10.

The purge ring 224 is substantially similar to the purge ring 24.

In particular, the purge ring 224 includes a base 262. However, unlike the purge ring 24, the purge ring 224 has no deflector.

The base 262 is substantially similar to the base 62 previously described. In particular, the base 262 delimits a central orifice 268, has a contour 270 and a side surface 272 extending between the central orifice 268 and the contour 270.

Unlike the purge ring 24, the purge ring 224 includes a cylindrical strainer (or device) 273 including a lower end and an upper end, and delimiting a side wall extending between the two ends.

The strainer 273 is fitted on the base 262 on the side of its upper end and defines an inner conduit 274 (visible in FIG. 10) extending the central orifice 268 along the central axis A-A'. The lower end is closed off.

The side wall of the strainer 273 includes at least one opening 282 communicating with the inner conduit 274 to favor a radial flow during the suctioning of the product 12.

Figure 9:
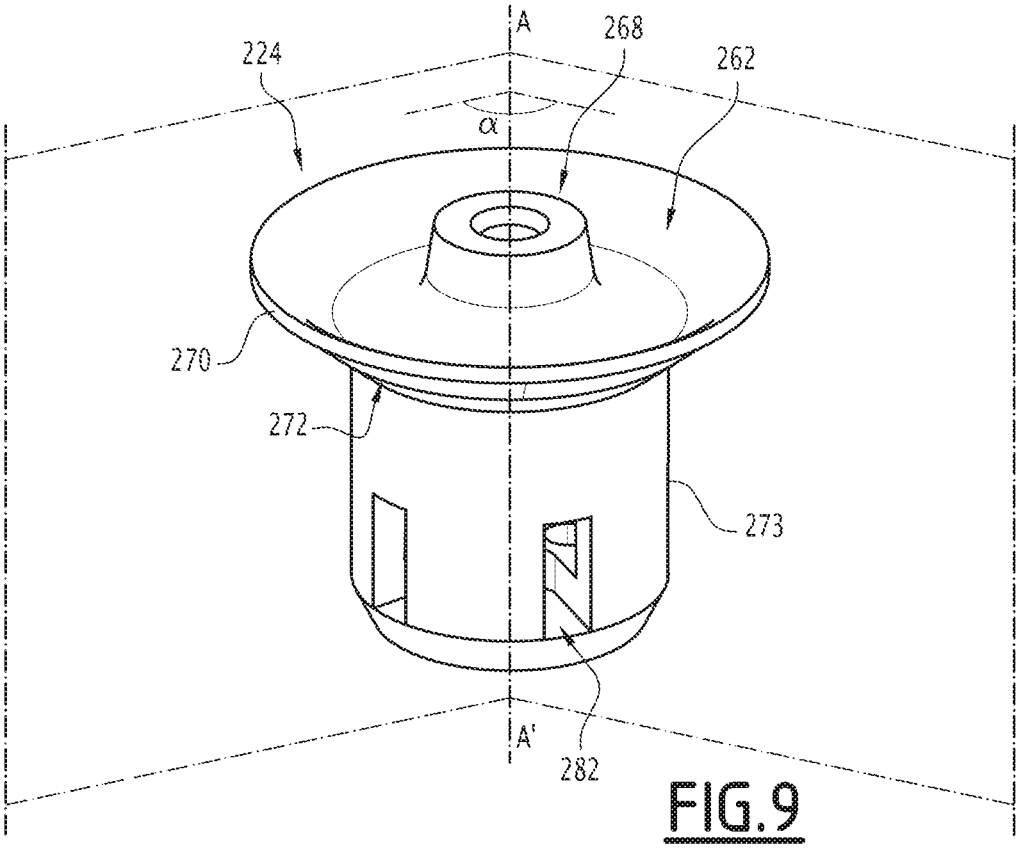
FIG. 9 is a perspective view of a purge ring according to a third embodiment of the invention.
Figure 10:
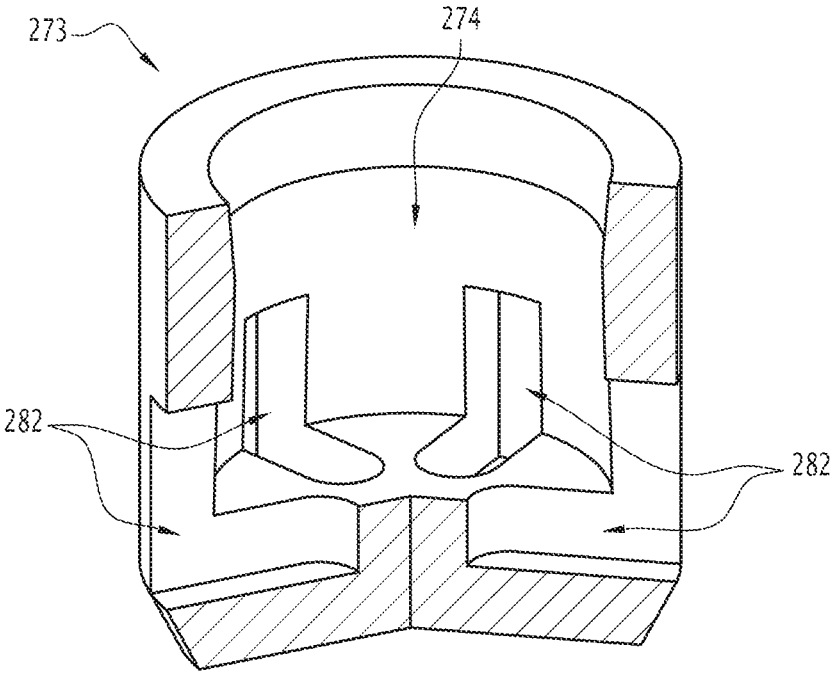
FIG. 10 is a sectional view in two radial half-planes of a detail of the purge ring of FIG. 9.

In FIGS. 9 and 10, the side wall of the strainer 273 delimits five openings 282 spaced regularly apart around the central axis A-A'. The radial spacing angle is thus substantially equal to 72°.

Similarly to FIG. 3, the angle α between two half-cutting planes of FIG. 9 is substantially equal to 144°, which makes it possible to view four openings 282, two of which are in sectional view, in FIG. 10.

According to one example embodiment, the strainer 273 is made in one piece with the base 262.

According to another example embodiment, the base 262 and the strainer 273 are made in the form of two separate parts.

The dispensing method carried out by a dispensing device with the dispensing ring 224 mounted therein is similar to that previously described.

In particular, the product 12 is suctioned through the radial opening(s) 282 of the strainer 273, which creates a radial component of the circulation speed of the product 12.

Preferably, a packaging and dispensing device 10 according to the invention comprises the purge ring 124, and in particular the purge ring according to the second example embodiment, described above, namely that illustrated in FIGS. 7 and 8.

What is claimed is:

1. A device for packaging and dispensing a product in an airless manner, said device comprising:

a container, defining an inner volume intended to contain the product, having two ends and a side wall extending between the ends along a longitudinal axis, the inner volume being closed off by a movable bottom and opening out through a dispensing neck, the side wall delimiting an inner surface of the inner volume;

a dispensing member comprising a dispensing pump fastened on the dispensing neck, said dispensing pump including a suction conduit for the product;

a purge ring comprising a base delimiting a central passage orifice for the product, the central passage orifice comprising a first end in which the suction conduit of the pump opens out and a second end opposite the first end, the central passage orifice defining a central axis of the ring extending between the first end and the second end;

the base having an outer contour and a side surface extending between the outer contour and the central passage orifice, the side surface converging from the outer contour toward the second end of the central passage orifice;

the outer contour of the ring coming into tight contact with the inner surface of the container; and a dead space formed between the purge ring and the dispensing member;

wherein the purge ring comprises at least one radial opening arranged radially relative to the central axis, the at least one radial opening emerging in the central passage orifice and allowing the passage of the product from the container toward the central passage orifice, wherein the at least one radial opening is formed by a deflector forming a deflection cap mounted on the second end of the central passage orifice, extending across from the side surface of the base and covering at least part of the side surface of the base, the side surface and the deflection cap forming at least one flow channel for the product between them connecting the at least one radial opening to the central passage orifice, wherein the at least one flow channel between the at least one radial opening and the central passage orifice extends in a direction towards the bottom of the container, wherein along a plane disposed generally orthogonal to the central axis and intersecting circumferentially extending portions of each of the base and the deflection cap defining the at least one radial opening, the circumferentially extending portion of the deflector is disposed radially outward of the circumferentially extending portion of the base.

2. The device according to claim 1, wherein the ring is fastened to the suction conduit by gripping of the suction conduit in the central passage orifice.

3. The device according to claim 1, wherein the base of the ring has a skirt extending around the central axis, the skirt defining the side surface;

the skirt converging from the outer contour of the base toward the second end of the central passage orifice.

4. The device according to claim 1, wherein the ring includes a central sleeve protruding in the base opposite the bottom, the central sleeve defining therein the first end of the central passage orifice.

5. The device according to claim 1, wherein the base of the ring and the deflector are made in a single integral piece.

6. The device according to claim 1, wherein the ring is manufactured by injection or by additive manufacturing.

7. The device according to claim 1, characterized in that the inner volume of the container comprises a product including at least one phase in the form of drops dispersed in another phase.

8. The device according to claim 1, wherein the side surface of the base is intended to partially close the inner volume.

9. A method for dispensing a product, in particular with several phases, comprising the following steps:

providing a dispensing device according to claim 1, the inner volume containing the product;

actuating the dispensing pump;

driving a movement of the product in the container; and suctioning the product through the at least one radial opening of the ring.

10. The device according to claim 1, wherein the at least one channel further includes a bend in a direction away from the bottom of the container and into an intersection with the central passage orifice.

11. The device according to claim 1, wherein the purge ring further includes additional flow channels extending radially through the purge ring, wherein the at least one flow channel and the additional flow channels are circumferentially spaced apart from one another at an external periphery of the purge ring, and wherein the at least one flow channel and the additional flow channels each intersect the central passage orifice.

12. The device according to claim 1, wherein the purge ring further includes additional flow channels extending radially through the purge ring, and wherein each of the additional flow channels and the at least one flow channel has a fluidly-separate intersection with the central passage orifice.

13. The device according to claim 12, wherein respective flows into each of the at least one flow channel and the additional flow channels intersect one another only downstream of said respective fluidly-separate intersections.

14. The purge ring according to claim 1, wherein the at least one radial opening is separated from an intersection of the flow channel with the central passage orifice in a direction of the longitudinal axis.

15. The purge ring according to claim 1, wherein the intersection of the flow channel with the central passage orifice is disposed along the longitudinal axis between the at least one radial opening and an end of the two ends opposite the dispensing member.

16. The purge ring according to claim 1, wherein the purge ring further includes additional radial openings each communicating within the purge ring with the central passage orifice, wherein the at least one radial opening and the plurality of radial openings are circumferentially spaced apart from one another at an external periphery of the purge ring.

17. A purge ring intended to be inserted into a device for packaging and dispensing a product, the purge ring comprising;

a base delimiting a central passage orifice for the product, the central passage orifice comprising a first end in which the suction conduit of the pump opens out and a second end opposite the first end, the central passage orifice defining a central axis of the ring extending between the first end and the second end;

the base having an outer contour and a side surface extending between the outer contour and the central passage orifice, the side surface converging from the outer contour toward the second end of the central passage orifice;

the outer contour of the ring being intended to come into tight contact with the inner surface of the container;

wherein the purge ring further comprises at least one radial opening arranged radially relative to the central axis, the at least one radial opening emerging in the central passage orifice and allowing the passage of the product from the container toward the central passage orifice, wherein the at least one radial opening is formed by a deflector forming a deflection cap mounted on the second end of the central passage orifice, extending across from the side surface of the base and covering at least part of the side surface of the base, the side surface and the cap forming at least one flow channel for the product between them connecting the at least one radial opening to the central passage orifice, wherein the at least one flow channel between the at least one radial opening and the central passage orifice extends in a direction towards the bottom of the container, wherein along a plane disposed generally orthogonal to the central axis and intersecting circumferentially extending portions of each of the base and the deflection cap defining the at least one radial opening, the circumferentially extending portion of the deflector is disposed radially outward of the circumferentially extending portion of the base.

18. A device for packaging and dispensing a product in an airless manner, said device comprising:

a container, defining an inner volume intended to contain the product, having two ends and a side wall extending between the ends along a longitudinal axis, the inner volume being closed off by a movable bottom and opening out through a dispensing neck, the side wall delimiting an inner surface of the inner volume;

a dispensing member comprising a dispensing pump fastened on the dispensing neck, said dispensing pump including a suction conduit for the product;

a purge ring comprising a base delimiting a central passage orifice for the product, the central passage orifice comprising a first end in which the suction conduit of the pump opens out and a second end opposite the first end, the central passage orifice defining a central axis of the ring extending between the first end and the second end;

the base having an outer contour and a side surface extending between the outer contour and the central passage orifice, the side surface converging from the outer contour toward the second end of the central passage orifice;

the outer contour of the ring coming into tight contact with the inner surface of the container; and a dead space formed between the purge ring and the dispensing member;

wherein the purge ring comprises at least one radial opening arranged radially relative to the central axis, the at least one radial opening emerging in the central passage orifice and allowing the passage of the product from the container toward the central passage orifice, wherein the at least one radial opening is formed by a deflector forming a deflection cap mounted on the second end of the central passage orifice, extending across from the side surface of the base and covering at least part of the side surface of the base, the side surface and the deflection cap forming at least one flow channel for the product between them connecting the at least one radial opening to the central passage orifice, wherein the at least one radial opening is separated from an intersection of the flow channel with the central passage orifice in a direction of the longitudinal axis.

* * * * *